US005631678A

United States Patent [19]

Hadimioglu et al.

[11] Patent Number: 5,631,678

[45] Date of Patent: May 20, 1997

[54] ACOUSTIC PRINTHEADS WITH OPTICAL ALIGNMENT

[75] Inventors: Babur B. Hadimioglu, Mountain View; Martin Lim, Union City, both of Calif.

[73] Assignee: Xerox Corporation, Stamford, Conn.

[21] Appl. No.: 349,296

[22] Filed: Dec. 5, 1994

[51] Int. Cl.[6] ..... B41J 2/04

[52] U.S. Cl. ..... 347/46; 359/619; 347/19

[58] Field of Search ..... 347/19, 46; 359/619

[56] References Cited

U.S. PATENT DOCUMENTS

| | | | |
|---|---|---|---|
| 4,308,547 | 12/1981 | Lovelady et al. | 347/46 |
| 4,360,273 | 11/1982 | Thaxter | 356/354 |
| 4,509,824 | 4/1985 | Yamasaki et al. | 359/619 X |
| 4,697,195 | 9/1987 | Quate et al. | 347/46 |
| 4,719,476 | 1/1988 | Elrod et al. | 347/46 |
| 4,719,480 | 1/1988 | Elrod et al. | 347/46 |
| 4,748,461 | 5/1988 | Elrod | 347/46 |
| 4,751,529 | 6/1988 | Elrod et al. | 347/46 |
| 4,751,530 | 6/1988 | Elrod et al. | 347/46 |
| 4,751,534 | 6/1988 | Elrod et al. | 347/46 |
| 4,959,674 | 9/1990 | Khri-Yakub et al. | 347/46 |
| 5,028,937 | 7/1991 | Khuri-Yakub et al. | 347/46 |
| 5,041,849 | 8/1991 | Quate et al. | 347/46 |
| 5,074,649 | 12/1991 | Hamanaka | 359/619 X |
| 5,087,931 | 2/1992 | Rawson | 347/46 |
| 5,111,220 | 5/1992 | Hadimioglu et al. | 347/46 |
| 5,121,141 | 6/1992 | Hadimioglu et al. | 347/46 |
| 5,122,818 | 6/1992 | Elrod et al. | 347/46 |
| 5,142,307 | 8/1992 | Elrod et al. | 347/46 |
| 5,216,451 | 6/1993 | Rawson et al. | 347/46 |
| 5,428,381 | 6/1995 | Hadimioglu et al. | 347/46 |

*Primary Examiner*—Mark J. Reinhart

[57] ABSTRACT

Acoustic printheads having an optically transparent substrate, at least two optical lenses, which may be part of the substrate, and a first structure, which may also be part of the substrate. The optical lenses focus light which irradiates the substrate into optical focal points at known locations relative to the first structure. The first structure may be part of an acoustic droplet ejector which includes an acoustic lens that is fabricated on the optically transparent substrate. The optical focal points can be used to precisely align the first structure with another structure.

1 Claim, 3 Drawing Sheets

ACOUSTIC PRINTHEADS WITH OPTICAL ALIGNMENT

FIELD OF THE INVENTION

This invention relates to acoustic printheads and to the optical alignment of printhead components with various structures.

BACKGROUND OF THE INVENTION

Acoustic droplet ejection has proven useful in a number of applications. Acoustic droplet ejection and some of those applications are described in the following U.S. Pat. Nos. and patent applications (and in their citations): 4,308,547 by Lovelady et al., entitled "LIQUID DROP EMITTER," issued 29 Dec. 1981; 4,697,195 by Quate et al., entitled "NOZZLELESS LIQUID DROPLET EJECTORS," issued 29 Sep. 1987; 4,719,476 by Elrod et al., entitled "SPATIALLY ADDRESSING CAPILLARY WAVE DROPLET EJECTORS AND THE LIKE," issued 12 Jan. 1988; 4,719,480 by Elrod et al., entitled "SPATIAL STABLIZATION OF STANDING CAPILLARY SURFACE WAVES," issued 12 Jan. 1988; 4,748,461 by Elrod, entitled "CAPILLARY WAVE CONTROLLERS FOR NOZZLELESS DROPLET EJECTORS," issued 31 May 1988; 4,751,529 by Elrod et al., entitled "MICROLENSES FOR ACOUSTIC PRINTING," issued 14 Jun. 1988; 4,751,530 by Elrod et al., entitled "ACOUSTIC LENS ARRAYS FOR INK PRINTING," issued 14 Jun. 1988; 4,751,534 by Elrod et al., entitled "PLANARIZED PRINTHEADS FOR ACOUSTIC PRINTING," issued 14 Jun. 1988; 4,959,674 by Khri-Yakub et al., entitled "ACOUSTIC INK PRINTHEAD HAVING REFLECTION COATING FOR IMPROVED INK DROP EJECTION CONTROL," issued 25 Sep. 1990; 5,028,937 by Khuri-Yakub et al., entitled "PERFORATED MEMBRANES FOR LIQUID CONTRONLIN ACOUSTIC INK PRINTING," issued 2 Jul. 1991; 5,041,849 by Quate et al., entitled "MULTI-DISCRETE-PHASE FRESNEL ACOUSTIC LENSES AND THEIR APPLICATION TO ACOUSTIC INK PRINTING," issued 20 Aug. 1991; 5,087,931 by Rawson, entitled "PRESSURE-EQUALIZED INK TRANSPORT SYSTEM FOR ACOUSTIC INK PRINTERS," issued 11 Feb. 1992; 5,111,220 by Hadimioglu et al., entitled "FABRICATION OF INTEGRATED ACOUSTIC INK PRINTHEAD WITH LIQUID LEVEL CONTROL AND DEVICE THEREOF," issued 5 May 1992; 5,121,141 by Hadimioglu et al., entitled "ACOUSTIC INK PRINTHEAD WITH INTEGRATED LIQUID LEVEL CONTROL LAYER," issued 9 Jun. 1992; 5,122,818 by Elrod et al., entitled "ACOUSTIC INK PRINTERS HAVING REDUCED FOCUSING SENSITIVITY," issued 16 Jun. 1992; 5,142,307 by Elrod et al., entitled "VARIABLE ORIFICE CAPILLARY WAVE PRINTER," issued 25 Aug. 1992; and 5,216,451 by Rawson et al., entitled "SURFACE RIPPLE WAVE DIFFUSION IN APERTURED FREE INK SURFACE LEVEL CONTROLLERS FOR ACOUSTIC INK PRINTERS," issued 1 Jun. 1993. U.S. patent application Ser. No. 08/245,322, entitled, "ACOUSTIC FABRICATION OF COLOR FILTERS," filed on 18 May 1994. Each of those patents and patent applications is hereby incorporated by reference.

Some applications of acoustic droplet ejection require an accurate alignment of either the acoustic droplet ejectors or of their various components to other structures. For example, consider the fabrication of liquid crystal display color filter arrays as described in U.S. patent application Ser. No. 08/245,322 entitled, "ACOUSTIC FABRICATION OF COLOR FILTERS," filed on 18 May 1994. The technique taught in that patent application involves acoustically ejecting droplets of color filter material (such as polyimide) onto a substrate using forces created by an ultrasonic transducer driven by an RF voltage. In operation, the acoustic forces pass thorough a base and into an acoustic lens which focuses the acoustic energy into a small focal area which is at, or is very near, the free surface of the material being ejected. Provided the energy of the acoustic beam is sufficiently great and properly focused, a droplet is ejected. By ejecting droplets at the proper locations, a color filter is formed on a color filter substrate. However, when fabricating color filters using acoustic droplet ejection the individual droplets should be placed with an accuracy of about 10 μm. This requires an accurate alignment between the acoustic droplet ejectors and the color filter substrate.

While the above describes acoustic fabrication of color filters, other depositions, such as conformal coatings, chemical and biological agents, and inks may also need to be deposited highly accurately.

While accurate alignments between acoustic droplet ejectors and external structures may be important, it may be even more important to accurately align various internal structures which comprise the acoustic printhead. For example, an acoustic printhead may contain thousands of transducers on the rear surface of a substrate which has thousands of acoustic lenses on its front surface. Successful operation of the acoustic printhead requires that the transducers axially align with the lenses to an accuracy of better than 10 μm. This can be difficult to achieve using standard alignment techniques.

In view of the above, techniques which enable precise alignment of acoustic printheads or of their components with various structures would be useful.

SUMMARY OF THE INVENTION

The present invention provides for acoustic printheads which are capable of precise alignment with various structures. The inventive acoustic printheads are comprised of an optically transparent substrate, at least two optical lenses, which may be part of the substrate, arm a first structure, which may also be part of the substrate. The optical lenses focus light which irradiates the substrate into optical focal points at known locations relative to the first structure. The spots produced by the optical focal points can be used to align a second structure with the first structure. The first structure may be part of an acoustic droplet ejector which includes an acoustic lens that is fabricated on the optically transparent substrate. As used herein, optical and its derivatives, and light and its derivatives, refer to an electromagnetic wave, or of pertaining to an electromagnetic wave, having a wavelength between the infrared and the ultraviolet. Beneficially the acoustic printheads may include one or more acoustic droplet ejectors, each of which has an acoustic lens which is fabricated on the optically transparent substrate. The optical lenses can then be used to focus light irradiated onto the substrate into spots which can be used to precisely align the acoustic lens or lenses with another structure such as a color filter substrate. Beneficially, both the acoustic and the optical lenses are Fresnel lenses since this enables concurrent fabrication of all lenses.

BRIEF DESCRIPTION OF THE DRAWINGS

Other aspects of the present invention will become apparent as the following description proceeds and upon reference to the drawings, in which.

Note that in the various figures that like numbers designate like elements. Additionally, the subsequent text includes various directional signals (such as right, left, up, down, top, bottom, lower and upper) which are taken relative to the figures. Those signals are meant to aid the understanding of the present invention, not to limit.

DETAILED DESCRIPTIONS OF THE PREFERRED EMBODIMENTS

The principles of the present invention are useful for aligning acoustic printheads, or components thereof, with either external or internal structures. When used to align acoustic printheads with external structures an accurate placement of ejected droplets onto those eternal structures is possible. When used to align acoustic printheads with internal structures an accurate alignment of components which comprise the acoustic printhead is possible.

A First Embodiment Acoustic Printhead

Figure 1:
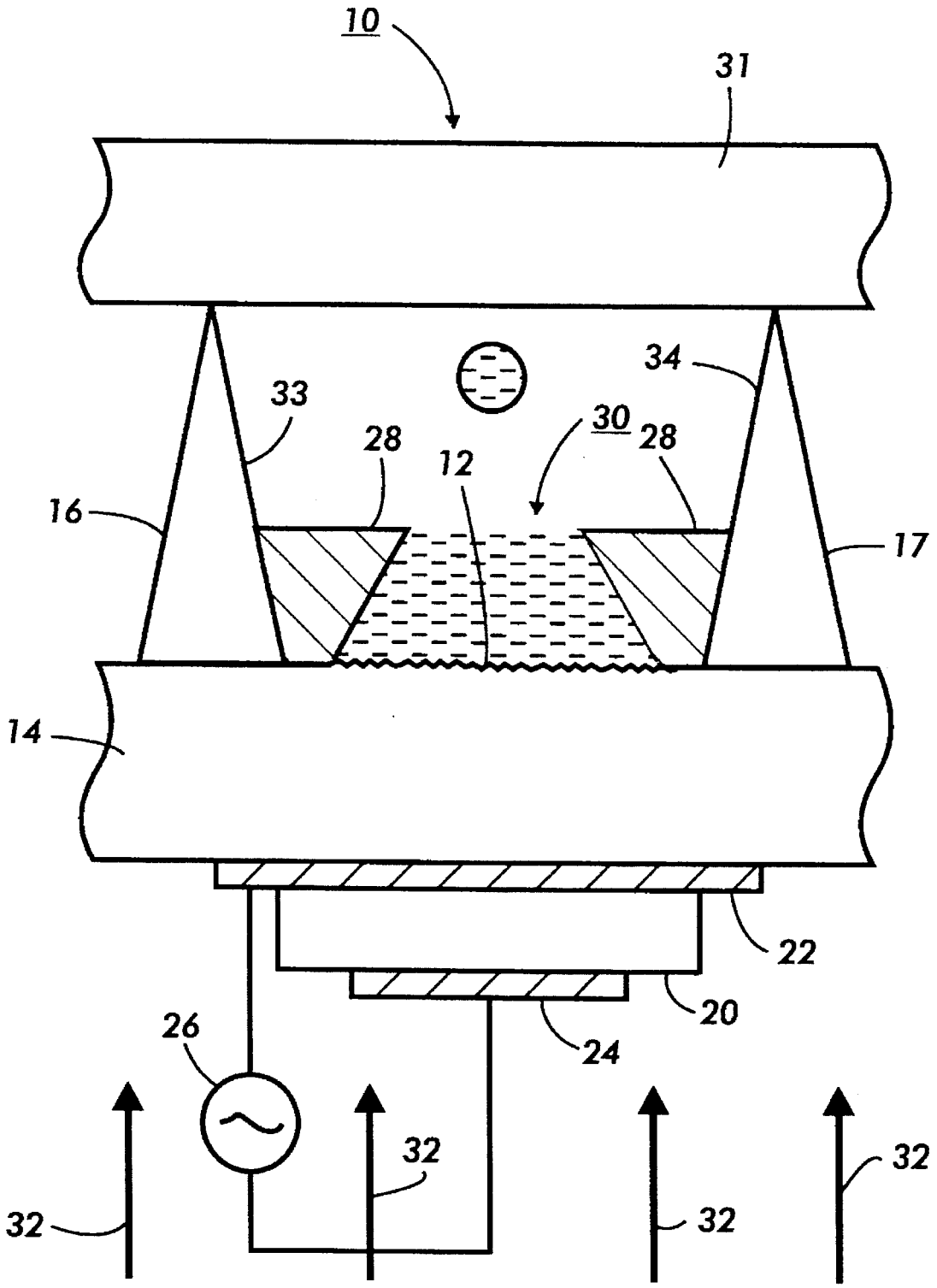
FIG. 1 schematically illustrates a simplified side view of a prototypical first embodiment acoustic printhead according to the principles of the present invention.

Refer now to FIG. 1 for a schematic illustration of a prototypical acoustic printhead 10 which is in accord with the principles of the present invention.

While the purpose of the printhead 10 is to eject color filter material onto a color filter substrate, that purpose is illustrative only. Printheads which eject other materials are also possible and are contemplated.

The printhead 10 shows an acoustic droplet ejector (described in more detail below) which is comprised of an acoustic lens 12 that is fabricated on an optically transparent printhead substrate 14. As shown, that substrate also has two optical lenses, the lens 16 and 17, one on each side of the acoustic lens 12. While FIG. 1 shows only one acoustic lens and two optical lenses, in practice many, perhaps thousands, of acoustic lenses and several more optical lenses may be located on the same substrate 14. At present, four (4) optical lenses, one at each corner of the substrate is preferred.

While the optical lenses 16 and 17 could be focusing geometric lenses, in practice Fresnel lenses will usually be preferred. This is because Fresnel lenses can readily be fabricated on the printhead substrate 14 contemporaneously with the acoustic lens 12, if that acoustic lens is also an acoustic Fresnel lens. For example, one way of fabricating all lenses contemporaneously is to form the lenses by heating the printhead substrate 14 until it becomes soft, and then pressing dies which correspond to the shape and locations of the desired lenses into the soft printhead substrate. When the printhead substrate cools the die-formed impressions form the lenses.

Another way of fabricating Fresnel lenses 16 and 17 contemporaneously with the acoustic lens 12 is to use chemical etching. Such etching processes are taught in United States Pat. Nos. 5,041,849, issued 20 Aug. 1991 to Quate et al. and 5,278,028, issued 11 Jan. 1994 to Hadimioglu et al. Both of those patents are hereby incorporated by reference. While those patents specifically describe the fabrication of multi-discrete-phase acoustic Fresnel lenses (which can, but need not, be used with the present invention), their etching processes make use of basic conventional photolithography. Briefly, one or more layers of etchable materials (the optical lenses must pass light, the acoustic lenses need not) are deposited on the substrate 14. Using suitable masking masks and etchants, the various lenses are etched. It is worth noting that the features required in both the acoustic and optical Fresnel lenses are consistent with the capabilities of modern photolithography. However, because of the importance of acoustic lenses to to acoustic ejection, it will generally be required to optimize the chemical etching processes to the fabrication of the acoustic lenses. Frequently this will result in optical Fresnel lenses (which tend to operate best at discrete wavelengths and harmonics thereof) which are not optimum for the available light. In such cases, it may be required to provide light at suitable wavelengths to operate the optical Fresnel lenses.

After lenses 12, 16 and 17 are fabricated, the remainder of the printhead 10 is produced. A ZnO transducer 20 having a top electrode 22 and a bottom electrode 24 is fabricated on the backside of the printhead substrate 14 in axial alignment with the acoustic lens 12. This transducer is meant to be selectively coupled via the top and bottom electrodes to a source 26 of RF drive energy. A fluid holder 28 is then bonded to the top side of the printhead substrate 14 such that a fluid chamber is formed by the fluid holder and the printhead substrate. That fluid chamber, which is axially aligned with the transducer 20 and the acoustic lens 12, holds a liquid color filter material 30 such that the liquid has a free surface from which droplets can be ejected onto a filter substrate 31.

Operation of the printhead 10 is rather straightforward. Before depositing color filter material 30 onto the filter substrate 31, the optical lenses 16 and 17 are used to align their relative positions of the printhead 10 with the filter substrate 31. This is accomplished by radiating light 32 through the printhead substrate 14 and into the lenses 16 and 17. Those lenses focus their received light into focused beams 33 and 34 having focal areas at known positions in front of the printhead substrate 14. By locating the printhead 10 near the filter substrate 31, the focused light beams 33 and 34 produce small, beneficially micron-sized, spots on the filter substrate 31.

The spots produced on the filter substrate are alignment marks. Alignment can be performed in many ways. For example, the spots can simply be used to visually position the printhead 10 relative to the filter substrate 31. Another way to use the spots is to embed sensors into the filter substrate 31 and to use the output of those sensors to determine the position of the spots.

After alignment of the printhead 10 with the filter substrate 31, RF drive energy from the source 26 is applied to the transducer 20. The resulting acoustic energy passes through the substrate 14 and into the acoustic lens 12. That acoustic lens focuses its received acoustic energy into a focal area which is at or is very near the free surface of the color filter material 30. A droplet of the color filter material is then ejected from the free surface onto the filter substrate 31 at known locations.

An Improved Droplet Ejector

Figure 2:
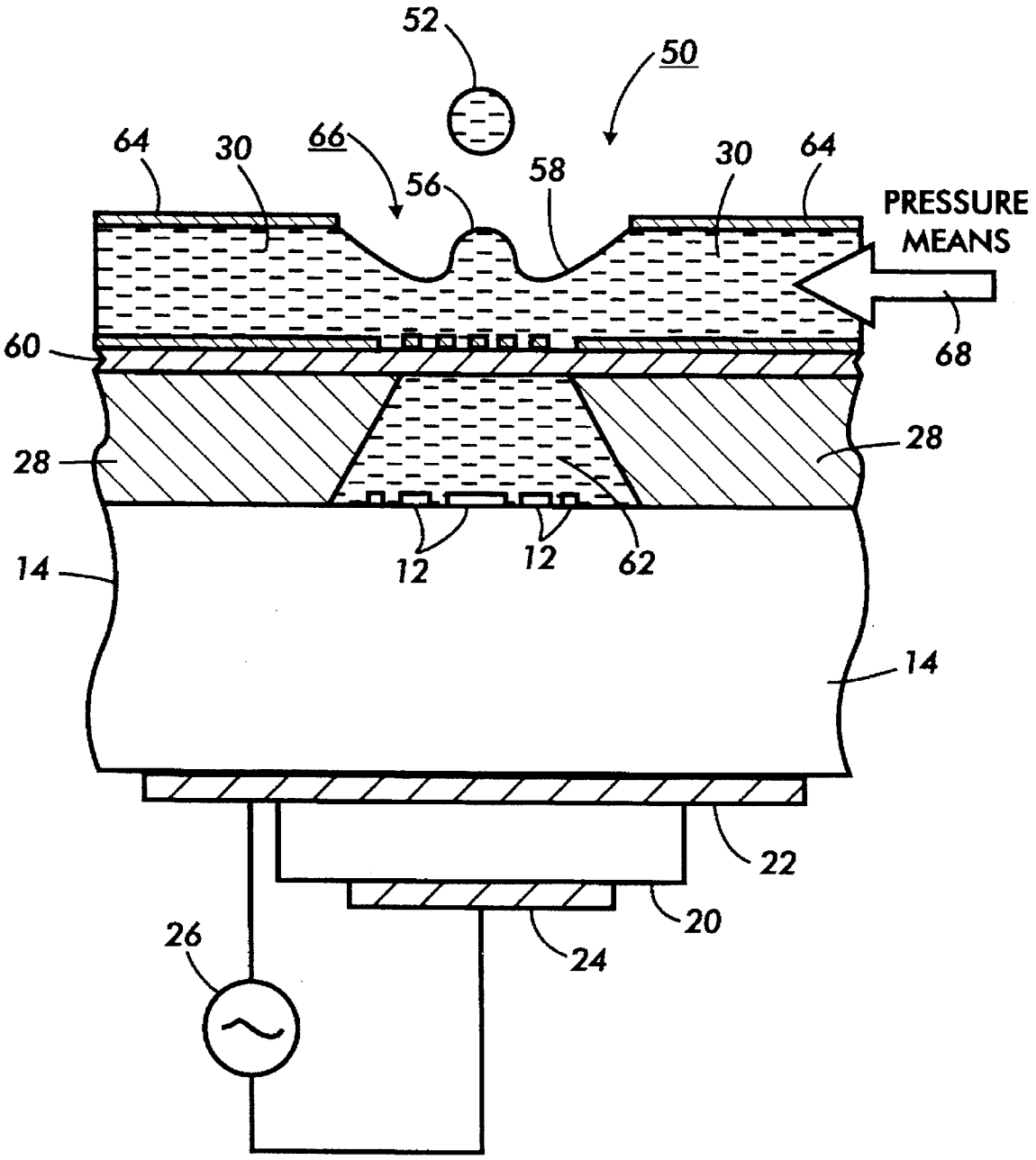
FIG. 2 schematically illustrates a side view of a preferred droplet ejector which can be incorporated into acoustic printheads according to the principles of the present invention.

While the embodiment illustrated in FIG. 1 lends itself to an enabling description of the principles of the present invention, in practice its droplet ejector is not optimal. The main problem with the droplet ejector of FIG. 1 is the rather high acoustic attenuation of the acoustic energy as it passes through the color filter material 30. A droplet ejector 50 having lower acoustic attenuation is shown in FIG. 2. FIG. 2 shows the droplet ejector 50 shortly after ejection of a droplet 52 of color filter material 30 and before the mound 56 on the free surface 58 of the color filter material from which the droplet is ejected has relaxed.

The acoustic droplet ejector 50 is in many ways similar to the acoustic droplet ejector described above with respect to FIG. 1. A ZnO transducer 20, which is driven by an RF driver source 26 via a bottom electrode 24 and a top electrode 22, generates acoustic energy which passes through the printhead substrate 14 and into the acoustic lens 12. Above the printhead substrate 14 is a fluid holder 28 which forms a fluid chamber with the printhead substrate.

However, unlike the acoustic droplet ejector in FIG. 1, the acoustic droplet ejector 50 includes an acoustically thin membrane 60 over the fluid holder 28 which converts the previous fluid chamber into a closed cell. That cell is filled with a liquid 62 which has a low acoustic attenuation. By acoustically thin it is meant that the thickness of the membrane 60 is small enough that the membrane passes over 50% of its incident acoustic energy through to the color filter material. A good rule of thumb is that the thickness of the membrane should be less then 10% of the acoustic wavelength of the incident sound in the liquid 62. Beneficially the membrane is either mylar or parylene, while the liquid 62 is beneficially water.

The acoustic droplet ejector 50 also includes a reservoir 64 with an aperture 66. That reservoir is located over the membrane 60 such that the aperture is axially aligned with the transducer 20. The reservoir is filled with the color filter material 30. The reservoir also includes pores which enable the color filter material 30 to pass through the reservoir into the aperture so as to create a pool of color filter material over the membrane 60. A pressure means 68 may be required to force the color filter material through the pores.

The droplet ejector 50 is dimensioned so that the free surface 58 of the color filter material is at, or is very near, the acoustic focal area. Since the membrane 60 is acoustically thin (as described above), the acoustic energy readily passes through the membrane and into the overlaying color filter material 30.

The principle difference between the acoustic droplet ejectors shown in FIGS. 1 and 2 is that the ejector of FIG. 2 has a closed cell containing a liquid 62 with low acoustic attenuation. Acoustic energy which passes from the printhead substrate 14 into the liquid 62 passes with little attenuation to its focal area. In contrast, acoustic energy in the droplet ejector of FIG. 1 must pass through the color filter material 30, which may attenuate the acoustic energy such that droplet ejection becomes problematic. Of course when the droplet ejector 50 is used its components (such as the membrane 60 and the reservoir 64) must not block either the light 32 or the focused light beams 33 and 34 (shown in FIG. 1).

A Second Embodiment Acoustic Printhead

Figure 3:
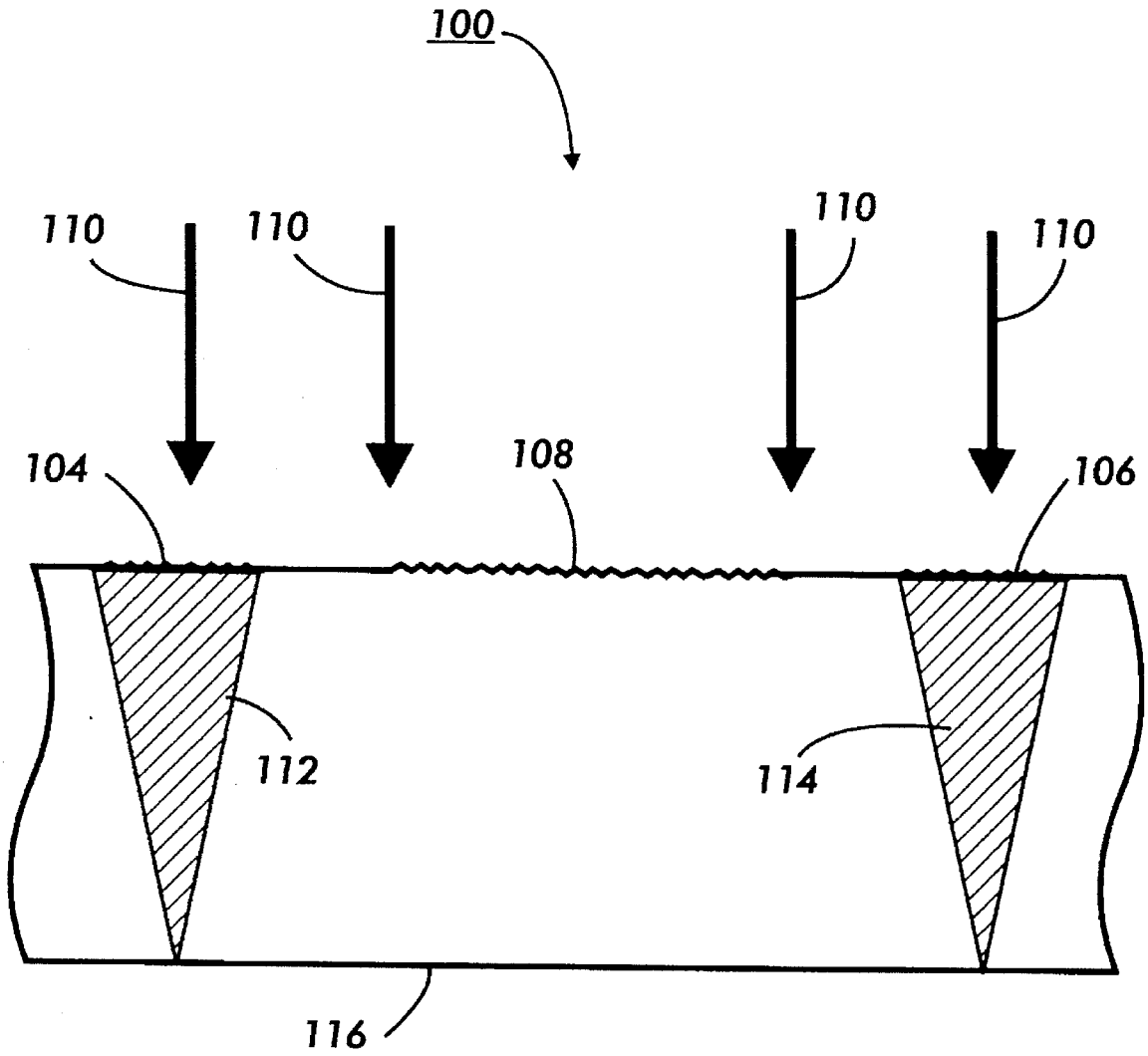
FIG. 3 schematically illustrates a simplified side view of a prototypical second embodiment acoustic printhead according to the principles of the present invention.

The first embodiment acoustic printhead 10 is useful for alignment of the printhead with an external structure such as a color filter substrate. However, the principles of the present invention may also be used to align structures comprising the acoustic printhead itself. For example, FIG. 3 shows an acoustic printhead 100 which includes an optically transparent substrate 102 having optical Fresnel lenses 104 and 106 and an acoustic lens 108. Fabrication of those lenses is similar to the fabrication of lenses 12, 16, and 17 of the acoustic printhead 10.

The purpose of the acoustic printhead 100 is to provide for the alignment of a transducer (not shown) with the acoustic lens 108. To do this, the lenses 104 and 106 receive light 110 which they focus into cones 112, and 114 within the substrate 102. The focusing area of those cones produce small (beneficially micron-sized) spots on the bottom surface 116 of the substrate. Those spots can be used to align the transducer with the acoustic lens 108. Alignment can be done either by aligning the transducer to the focused spots or by exposing a photoresist layer (not shown) which covers the bottom side 116 so as to define permanent alignment marks on the rear side.

It should be also noted that other internal structures can be aligned with the lenses 104 and 106. For example, those lenses can be used to align channel plates to the acoustic Fresnel lenses. In that case, optical lenses can be formed in unused areas of the substrate 102 so that they do not interfere with the remainder of the acoustic printhead.

It is to be understood that while the figures and the above description illustrate the present invention, they are exemplary only. Others will recognize numerous modifications and adaptations of the illustrated embodiment which are in accord with the principles of the present invention. Therefore, the present invention is to be limited only by the appended claims.

What is claimed is:

1. An acoustic printhead comprised of:

an optically transparent substrate having a first surface, a second surface, and a first structure at a fixed position, wherein said first structure is an acoustic lens; and at least two optical lenses on said first surface, said optical lenses for receiving radiant light and for focusing said received radiant light into at least two optical focal areas which are at fixed positions relative to said first structure.

* * * * *